US009834871B2

(12) United States Patent
Lee

(10) Patent No.: US 9,834,871 B2
(45) Date of Patent: Dec. 5, 2017

(54) METHOD FOR KNITTING INTERCHANGED PLATING ON A TECHNICAL FACE OF A FABRIC FOR FLAT BED KNITTING MACHINES

(71) Applicant: PAI LUNG MACHINERY MILL CO., LTD., New Taipei (TW)

(72) Inventor: Chih-Chiang Lee, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 203 days.

(21) Appl. No.: 14/645,078

(22) Filed: Mar. 11, 2015

(65) Prior Publication Data

US 2016/0265148 A1 Sep. 15, 2016

(51) Int. Cl.

| | |
|---|---|
| ***D04B 15/70*** | (2006.01) |
| ***D04B 15/90*** | (2006.01) |
| ***D04B 1/12*** | (2006.01) |
| ***D04B 7/26*** | (2006.01) |
| ***D04B 15/06*** | (2006.01) |

(52) U.S. Cl.

CPC ..... *D04B 15/70* (2013.01); *D04B 1/126* (2013.01); *D04B 7/26* (2013.01); *D04B 15/06* (2013.01); *D04B 15/90* (2013.01)

(58) Field of Classification Search

CPC ..... D04B 14/70; D04B 14/90; D04B 14/06; D04B 7/26; D04B 1/126

USPC ..... 66/60 R, 64, 96 R, 75.1, 106, 109

See application file for complete search history.

(56) References Cited

U.S. PATENT DOCUMENTS

| | | | | | |
|---|---|---|---|---|---|
| 1,977,590 | A * | 10/1934 | Page | D04B 9/26 | 66/108 R |
| 2,050,962 | A * | 8/1936 | Page | D04B 9/26 | 66/107 |
| 3,859,824 | A * | 1/1975 | Krylov | D04B 15/06 | 66/10 |
| 4,103,517 | A * | 8/1978 | Schmid | D04B 15/70 | 66/64 |
| 5,010,744 | A * | 4/1991 | Kawase | D04B 15/06 | 66/107 |
| 5,557,948 | A * | 9/1996 | Shima | D04B 7/26 | 66/106 |
| 5,636,532 | A * | 6/1997 | Shima | D04B 15/10 | 66/109 |

(Continued)

*Primary Examiner* — Danny Worrell
*Assistant Examiner* — Jocelyn Wu
(74) *Attorney, Agent, or Firm* — Muncy, Geissler, Olds & Lowe, P.C.

(57) ABSTRACT

A method for knitting interchanged plating on a technical face for a flat bed knitting machine which includes at least one needle bed that has a plurality of latch needles, a plurality of sinkers and a carriage comprises the steps of: forming an indentation and a nose protrusion at each sinker; controlling the latch needle to move in a staged stitching displacement; feeding a first and a second coloration yarns to the flat bed knitting machine simultaneously; pushing the yarns via the nose protrusion of the sinker to knit a standard plating and continuing the knitting operation through the standard plating to form a technical face of the fabric; and controlling the latch needle to perform an interchanged stitching displacement, and ordering the sinker to pick up and release the yarns through the nose protrusion and the indentation to knit an interchanged plating.

5 Claims, 11 Drawing Sheets

(56) References Cited

U.S. PATENT DOCUMENTS

| | | | | |
|---|---|---|---|---|
| 6,018,966 | A * | 2/2000 | Shima | D04B 1/02 66/64 |
| 6,079,233 | A * | 6/2000 | Shima | D04B 15/06 66/106 |
| 6,568,222 | B1 * | 5/2003 | Morita | D04B 15/06 66/106 |
| 6,883,352 | B2 * | 4/2005 | Miyai | D04B 7/04 66/64 |

* cited by examiner

METHOD FOR KNITTING INTERCHANGED PLATING ON A TECHNICAL FACE OF A FABRIC FOR FLAT BED KNITTING MACHINES

FIELD OF THE INVENTION

The present invention relates to a plating method for flat bed knitting machines and particularly to a method for knitting interchanged plating on a technical face of a fabric for flat bed knitting machines.

BACKGROUND OF THE INVENTION

A conventional flat bed knitting machine generally has a front needle bed and a rear needle bed. During knitting operation one of the needle beds can be used to do technical face knitting, or the front and rear needle beds also can be used at the same time interchangeably to do technical face knitting or interlocked double faces knitting. The technical face knitting also is called plain stitch. The knitting fabrics it produced have a technical face to be used as the front face of the fabrics. Plating also is called yarn adding or yarn stacking, and is a process by feeding two yarns of different colors at the same time during the knitting operation to produce a fabric with different colors on the technical face and a technical back. In order to increase fabric color changes or pattern variations a technique of feeding two different colors of yarns at the same time and doing plain stitch at the front needle bed and reverse stitch at the rear needle bed to form plating to generate the color changes or pattern variations of the fabric also is available at present. Namely, the present knitting technique can produce fabrics with plating on the technical back interwoven in the plating on the technical face in a predetermined segment, and the plating of the technical back appeared on the technical face can be used as the front face of the fabric. The fabric with the plating formed via reverse stitch has a back side structure and different colors of plating on the technical back to form Jacquard effect on the plating of the technical face like a Jacquard fabric.

It is generally known that the market requires the knitted fabrics to have different color changes and pattern variations. However, the fabric producers, in order to save production time and reduce knitting cost and increase production yield, often adopt the foresaid conventional technique to produce technical face plain stitch fabrics with plating on the technical back to meet market requirements. But the fabrics produced via the present technique cannot fully meet consumers' requirements. The main reason is that the structural appearance of the plating on the technical back of the technical face plain stitch fabric that adopted the present technique is different from that of the plating on the technical face. People with a general aesthetic sense can easily see the unmatched structural appearances of the two and feel it like the technical face of the fabric has been smeared by objects of different colors. Hence the fabric thus made has lost its appeal to the consumers. It urgently needs improvement to resolve this problem in the industry.

SUMMARY OF THE INVENTION

The primary object of the present invention is to solve the aforesaid problem of the conventional technique of forming unmatched structural appearance on the knitted fabric. The invention provides stitching operation through indentations and nose protrusions of sinkers to collaborate with different displacements of latch needles so that plating with change of different color of yarns can be accomplished through merely a same needle bed in plain stitch operation to get technical face fabrics with different color changes and pattern variations totally on the technical face. The fabrics thus made not only can better meet market requirements, also can save knitting time and reduce knitting operation cost and increase production yield.

To achieve the foregoing object the present invention provides a method for knitting interchanged plating on a technical face of technical face for flat bed knitting machines. Each flat bed knitting machine includes at least one needle bed which has a plurality of latch needles and a plurality of sinkers hinged on an upper end of the needle bed abutting respectively each latch needle. The invention also includes a carriage above the needle bed that is movable reciprocally and linearly. The method includes:

forming an indented indentation at a front end of each sinker that is movable interactively with each latch needle and a nose protrusion abutting the indentation;

controlling the carriage to move reciprocally and linearly above the needle bed so that the latch needle is moved in a staged stitching displacement which includes a pause stitching operation; the staged stitching displacement includes at least a first stitching section, a second stitching section and a delayed stitching section between the first and second stitching sections to generate the pause stitching operation;

feeding a first coloration yarn and a second coloration yarn above the first coloration yarn at the same time to the flat bed knitting machine;

moving the first coloration yarn and the second coloration yarn via a front edge of the nose protrusion to slide down for knitting while the latch needle is positioned at the second stitching section to form a standard plating in which the first coloration yarn below the second color yarn, and continuing the knitting operation through the standard plating to form a technical face of the fabric; and controlling the carriage to make the latch needle to perform an interchanged stitching displacement when the technical face fabric knitted via the standard plating has reached a predetermined position, and ordering the sinker during the latch needle is located in the interchanged stitching displacement to pick up the first coloration yarn above the second coloration yarn through the junction of a rear edge of the nose protrusion and the indentation, then releasing the yarns to form an interchanged plating in which the second coloration yarn below the first coloration yarn.

In one aspect in the method of the invention a contacting point of two ends of the interchanged plating also is the second coloration yarn located below the first coloration yarn.

In another aspect the sinker has a throat holding portion indented from a lower side of the front edge of the nose protrusion.

In yet another aspect the carriage includes at least a sinker control plates and a needle control plates located below the sinker control plates.

In yet another aspect the carriage is moved reciprocally and linearly above the needle bed to drive a distal end of the sinker to move up and down, and the sinker control plates has a sinker track formed thereon that includes at least a yarn picking displacement to allow the junction of the rear edge of the nose protrusion and the indentation to pick up the first coloration yarn above the second coloration yarn then release, and a yarn pushing displacement to push the first and second coloration yarns to slide down at the same time through the front edge of the nose protrusion; the yarn picking displacement including a yarn picking up slope section and a yarn picking down slope section, and the yarn pushing displacement including a yarn pushing up slope section and a yarn pushing down slope section.

In yet another aspect the carriage moves reciprocally and linearly above the needle bed to drive the latch needle to move up and down, and the needle control plates has a needle track formed thereon that includes the staged stitching displacement and the interchanged stitching displacement that can be switched with each other.

Through the technique set forth above, compared with the conventional technique, the present invention can provide many advantages, notably: 1. By collaborating the indentation and the nose protrusion of the sinker with the stitching operation of different displacements of the latch needle plating of the yarns of different colorations can be changed via a same needle bed to knit a technical face of the fabric with different color changes and pattern variations totally on the technical face, hence can resolve the problem of unmatched structural appearance of the fabric knitted via the conventional technique; 2. The fabric knitted via the invention not only can meet market requirements, also can save knitting time and reduce knitting operation cost and increase production yield.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
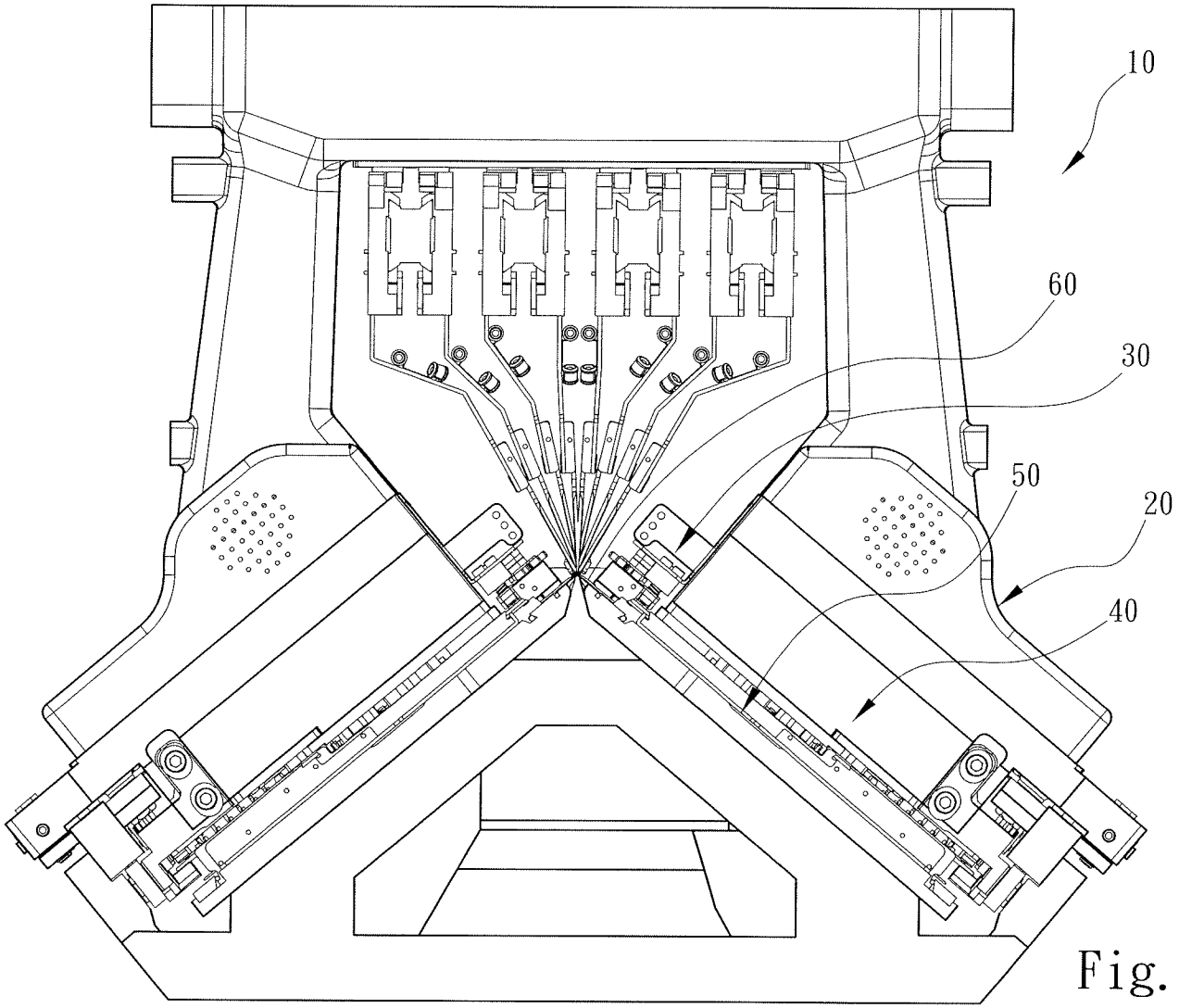
FIG. 1 is a fragmentary side view of a flat bed knitting machine according to an embodiment of the invention.
Figure 2:
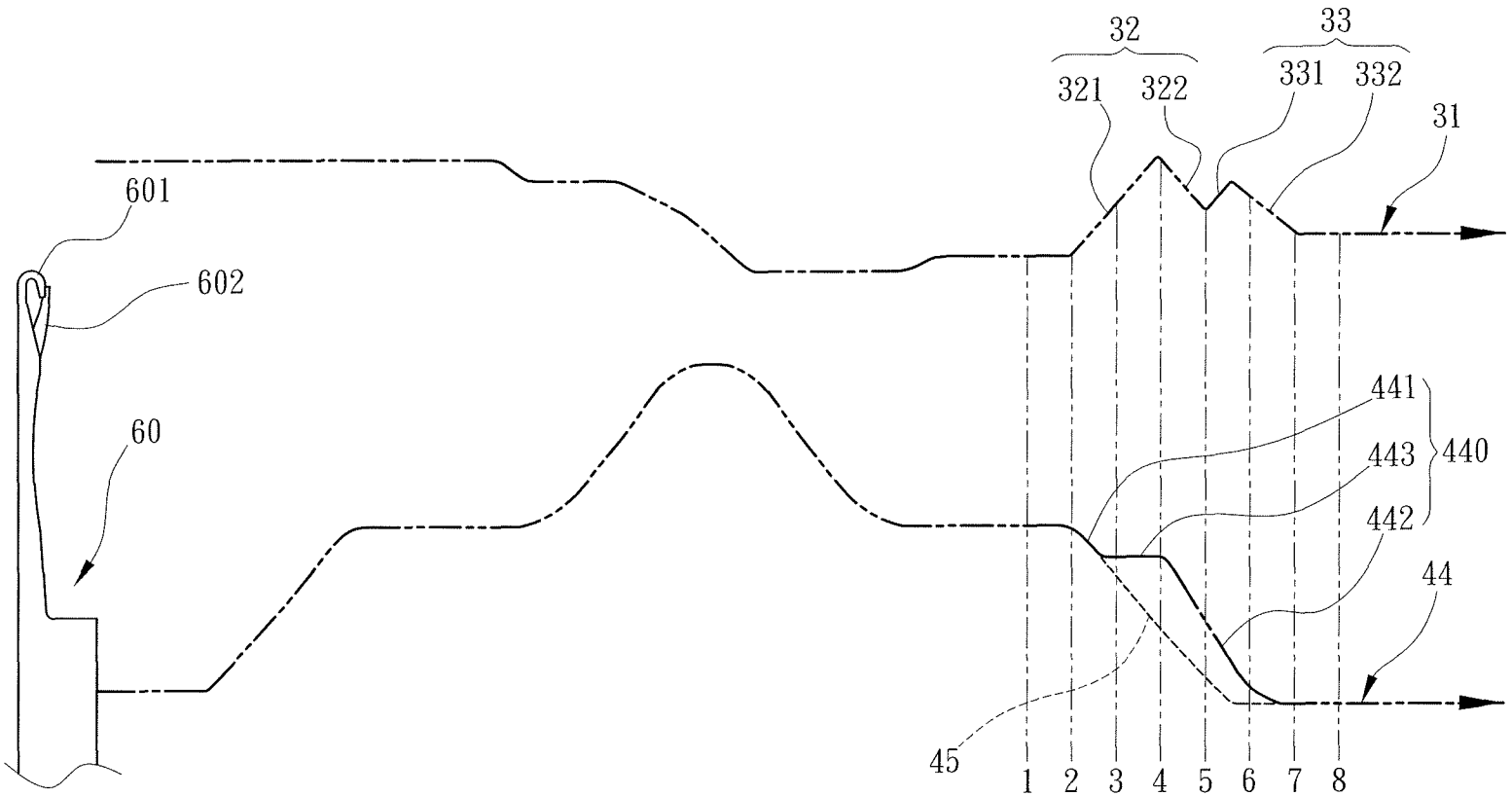
FIG. 2 is a fragmentary schematic plane view of the tracks of the sinker and the latch needle to knit standard plating according to the invention.
Figure 3:
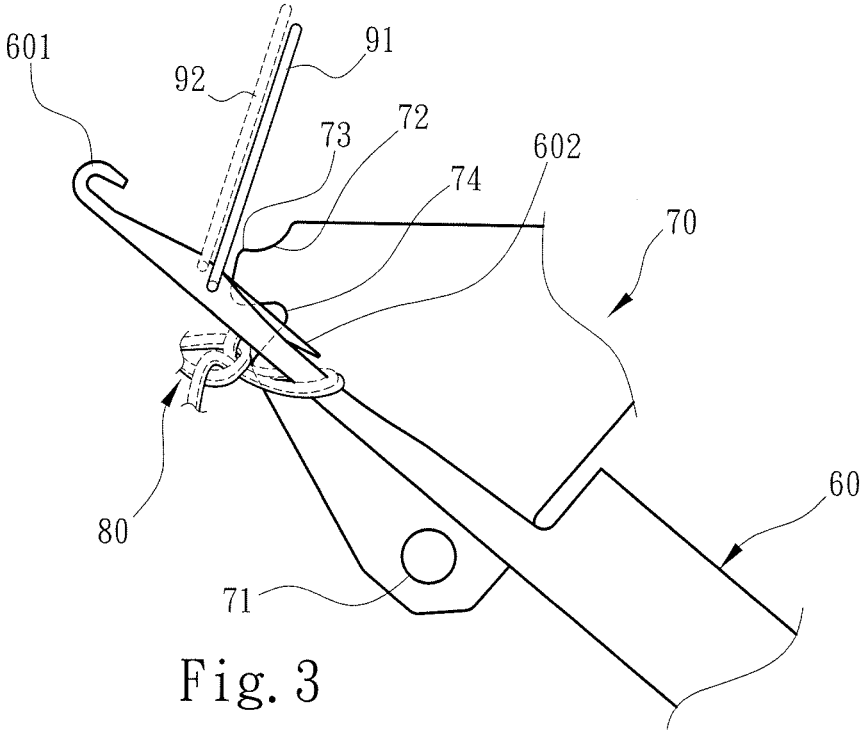
FIGS. 3 through 10 are fragmentary schematic views of the moment positions of the sinker and the latch needle in continuous operation conditions according to FIG. 2.

Please refer to FIGS. 1 through 3 for a flat bed knitting machine in an embodiment of the invention. The flat bed knitting machine 10 includes two needle beds 50 and a carriage 20 movable reciprocally and linearly above the needle beds 50. Each needle bed 50 has a plurality of latch needles 60 and a plurality of sinkers 70 hinged on an upper end of the needle bed 50 abutting respectively each latch needle 60 (location of the sinker 70 is known to those skilled in the art, hence is omitted in the drawings). The latch needle 60 has a hook 601 and a latch 602 at an upper end thereof. The carriage 20 includes at least one sinker control plates 30 and at least one needle control plates 40 located below the sinker control plates 30. The sinker 70 has an axle hole 71 hinged on the needle bed 50, and an indented indentation 72 at a front end thereof to form interactive movement with the latch needle 60 and a nose protrusion 73 (referring to FIG. 3) abutting the indentation 72, and also a throat holding portion 74 indented from a lower side of a front edge of the nose protrusion 73. The sinker 70 has a sinker foot (which also is known to those skilled in the art, hence also is omitted in the drawings) at a distal end thereof driven by the sinker control plates 30 to move up and down. When the sinker foot is moved up and down the indentation 72, the nose protrusion 73 and the throat holding portion 74 also are moved up and down at the same time through the hinged relationship with the axle hole 71.

Figure 9:
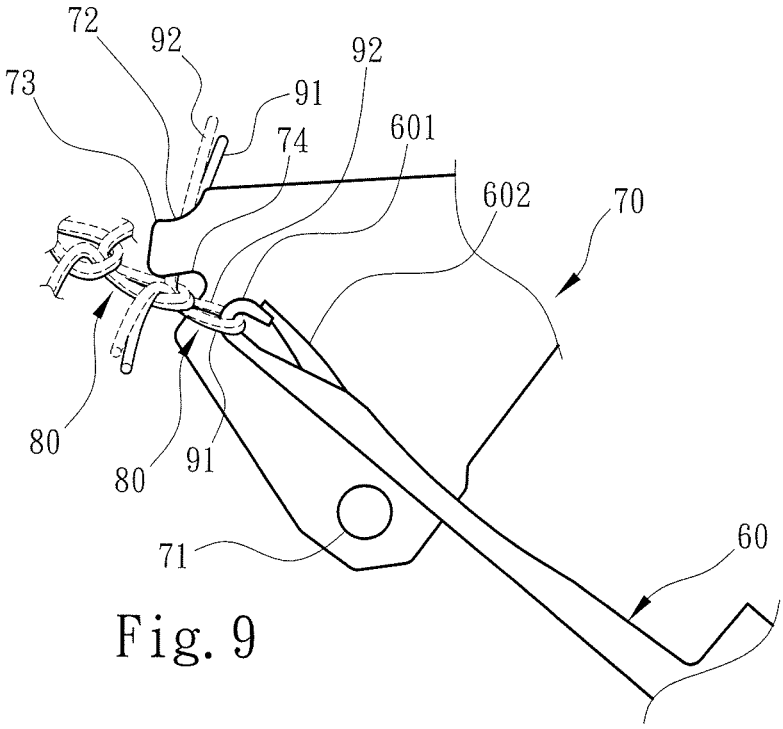
Figure 10:
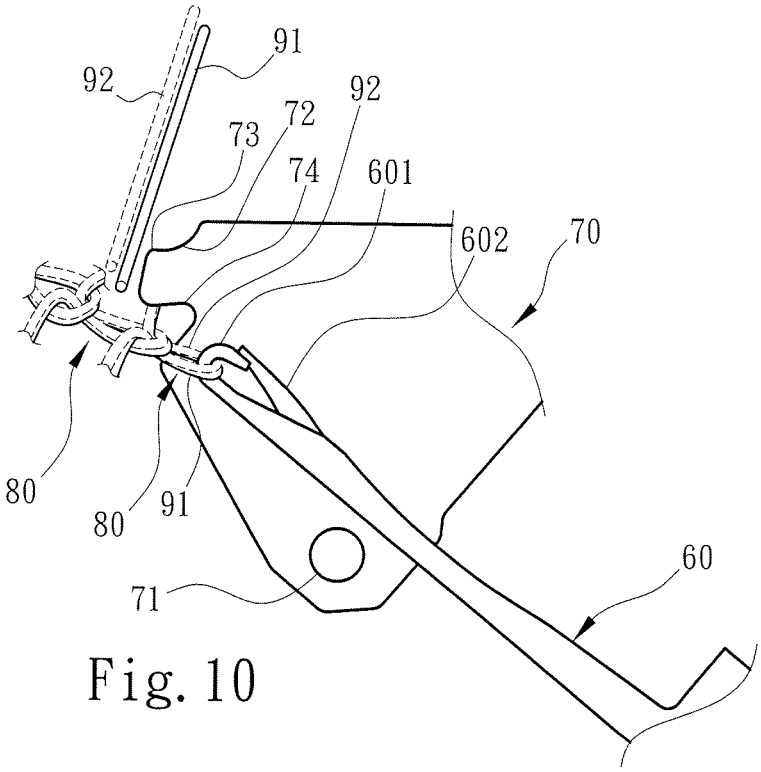
Figure 17:
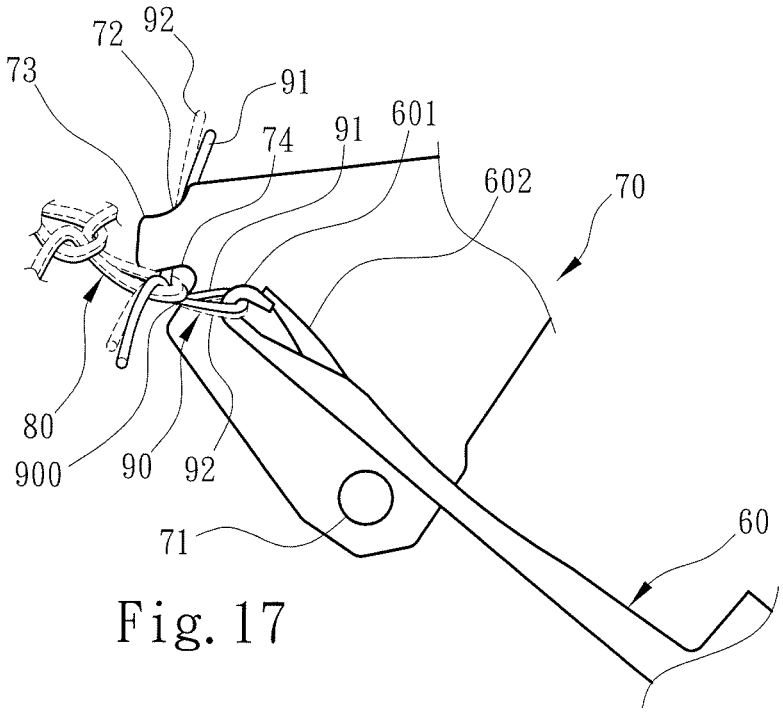
Figure 18:
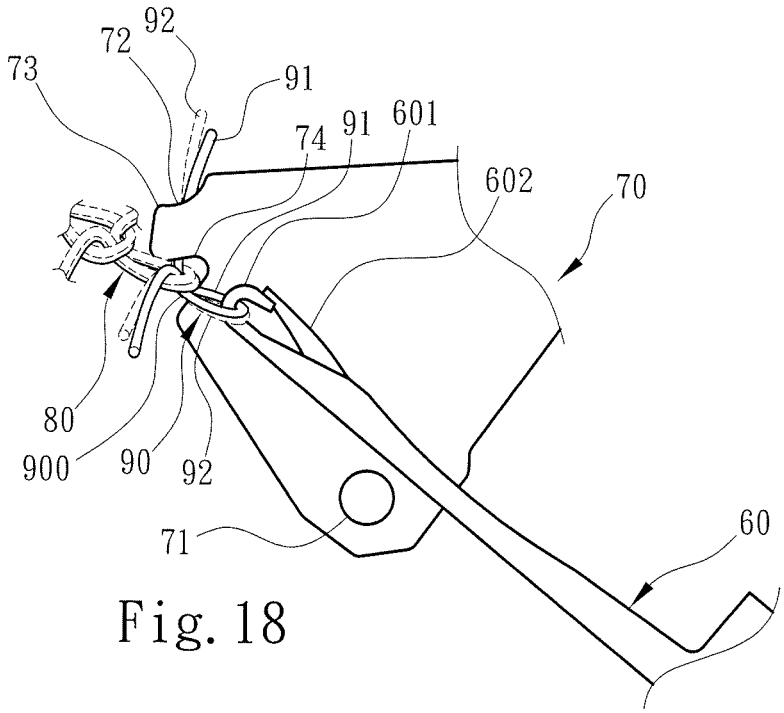
Figure 19:
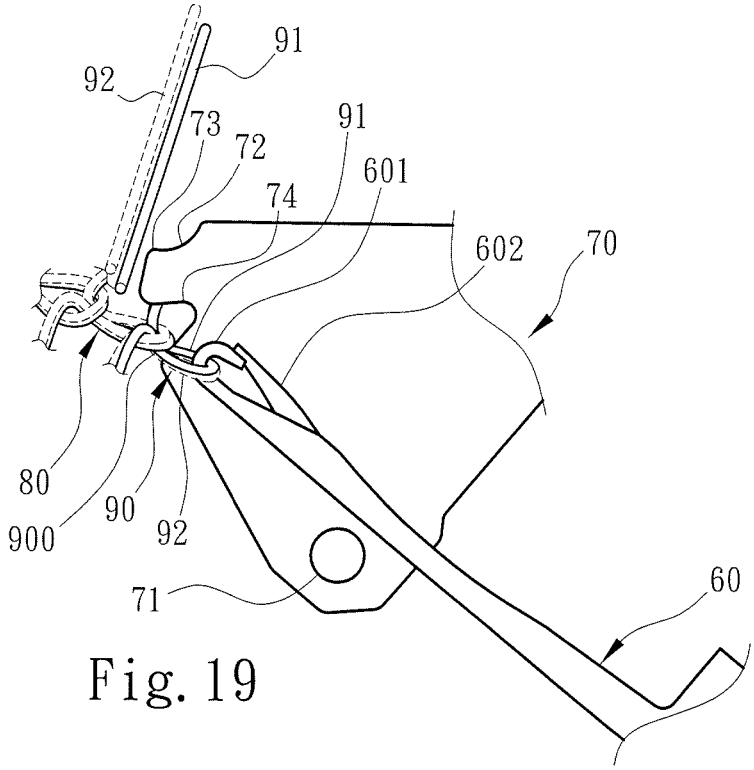

In the method for knitting interchanged plating on a technical face of a fabric for flat bed knitting machines of the invention the flat bed knitting machine 10 includes at least one needle bed 50 which has a plurality of latch needles 60 and a plurality of sinkers 70 hinged on the upper end of the needle bed 50 abutting respectively each latch needle 60, and also a carriage 20 movable reciprocally and linearly above the needle bed 50. The method includes the steps as follows:

forming an indented indentation 72 at a front end of each sinker 70 that is movable interactively with each latch needle 60 and a nose protrusion 73 abutting the indentation 72;

controlling the carriage 20 to move reciprocally and linearly above the needle bed 50 so that the latch needle 60 is moved in a staged stitching displacement 440 which includes a pause stitching operation; the staged stitching displacement 440 includes at least a first stitching section 441, a second stitching section 442 and a delayed stitching section 443 interposed between the first and second stitching sections 441 and 442 to generate the pause stitching operation;

feeding a first coloration yarn 91 and a second coloration yarn 92 above (or "behind", in terms of the technical face of the fabric knitted by the flat bed knitting machine 10) the first coloration yarn 91 at the same time to the flat bed knitting machine 10;

moving the first coloration yarn 91 and the second coloration yarn 92 via the front edge of the nose protrusion 73 of the sinker 70 to slide down for knitting while the latch needle 60 is positioned at the second stitching section 442 during a delayed stitching time generated when the latch needle 60 is located at the delayed stitching section 443, thereby form a standard plating 80 with the first coloration yarn 91 below (or "in front of", in terms of the technical face of the fabric knitted by the flat bed knitting machine 10) the second color yarn 92 (as shown in FIGS. 9 and 10), and continuing the knitting operation through the standard plating 80 to form a technical face of the fabric; and controlling the carriage 20 to make the latch needle 60 to perform an interchanged stitching displacement 45 when the technical face of the fabric knitted via the standard plating 80 has reached a predetermined position, and ordering the sinker 70 during the latch needle 60 is located in the interchanged stitching displacement 45 to stitch and move the first coloration yarn 91 down ward such that the junction of a rear edge of the nose protrusion 73 and the indentation 72 can pick up the first coloration yarn 91 above (or behind) the second coloration yarn 92, then release the yarn to perform knitting and form an interchanged plating 90 with the second coloration yarn 92 below the first coloration yarn 91 (as shown in FIGS. 17 through 19). It is to be noted that when the carriage 20 is moving reciprocally and linearly above the needle bed 50 to drive the distal end of the sinker 70 to move up and down the distal end of the sinker 70 forms a sinker tack 31 (indicated by a phantom line, or called chain line) on the sinker control plates 30, as shown in FIG. 2; the sinker track 31 includes at least a yarn picking displacement 32 in which the junction of the rear edge of the nose protrusion 73 and the indentation 72 picks up the first coloration yarn 91 above the second coloration yarn 92, then releases the yarn, and a yarn pushing displacement 33 to push the first and second coloration yarns 91 and 92 to slide down at the same time through the front edge of the nose protrusion 73; the yarn picking displacement 32 including a yarn picking up slope section 321 and a yarn picking down slope section 322, and the yarn pushing displacement 33 including a yarn pushing up slope section 331 and a yarn pushing down slope section 332 (as shown in FIG. 2 or 11).

The method of the invention is further elaborated as follows to make operation more understandable: please refer to FIGS. 2 and 11 for the schematic views of the tracks of the sinker and latch needle to form the standard plating and the interchanged plating. In addition to the sinker 70 to form the sinker track 31 on the sinker control plates 30, the latch needle 60 driven by the needle control plates 40 to move up and down also forms a needle main track 44 on the needle control plates 40 that includes the staged stitching displacement 440 and the interchanged stitching displacement 45 that can be switched with each other (indicated by the phantom line in the drawings). However, in FIG. 2, the staged stitching displacement 440 is abutted by the interchanged stitching displacement 45 (indicated by a hidden line) in the neighborhood; based on the interchanged stitching displacement 45, when the latch needle 60 is not being controlled by the carriage 20 to switch to the interchanged stitching displacement 45 it delays stitching in the staged stitching displacement 440 in normal conditions to knit the standard plating 80 by placing the second coloration yarn 92 above (or "behind", in terms of the technical face of the fabric knitted by the flat bed knitting machine 10) of the first coloration yarn 91, and the latch needle 60 forms the staged stitching displacement 440 on the needle control plates 40 in the normal conditions. In FIG. 11, it also can be seen that the interchanged stitching displacement 45 is abutted by the staged stitching displacement 440 in the neighborhood (indicated by the hidden line); hence when the latch needle 60 is controlled by the carriage 20 to form the interchanged stitching displacement 45 it stitches directly the interchanged plating 90 by placing the second coloration yarn 92 below (or "in front of", in terms of the technical face of the fabric knitted by the flat bed knitting machine 10) the first coloration yarn 91, thereby form the interchanged plating on the technical face.

Figure 4:
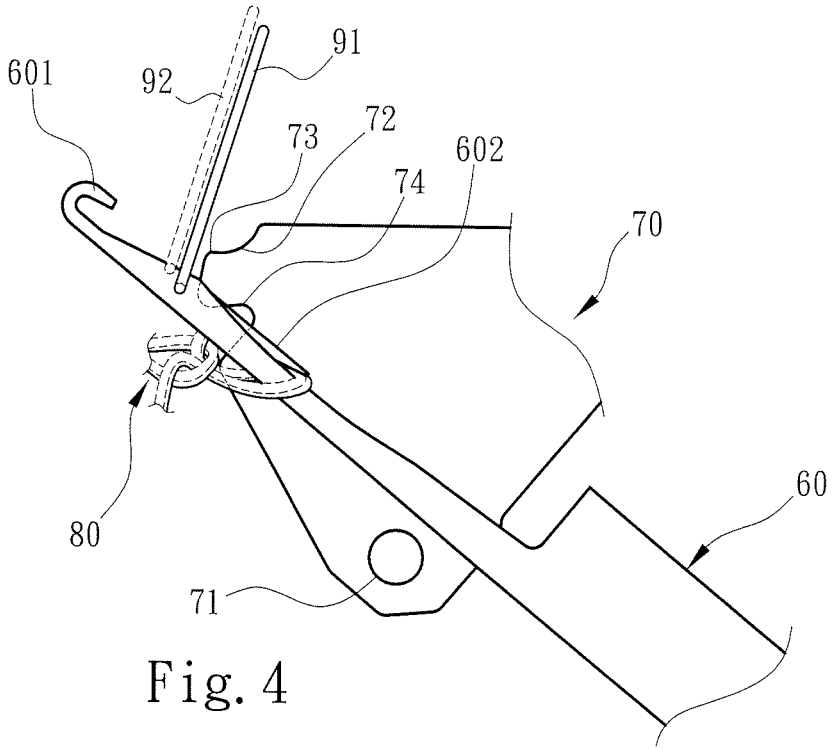
Figure 5:
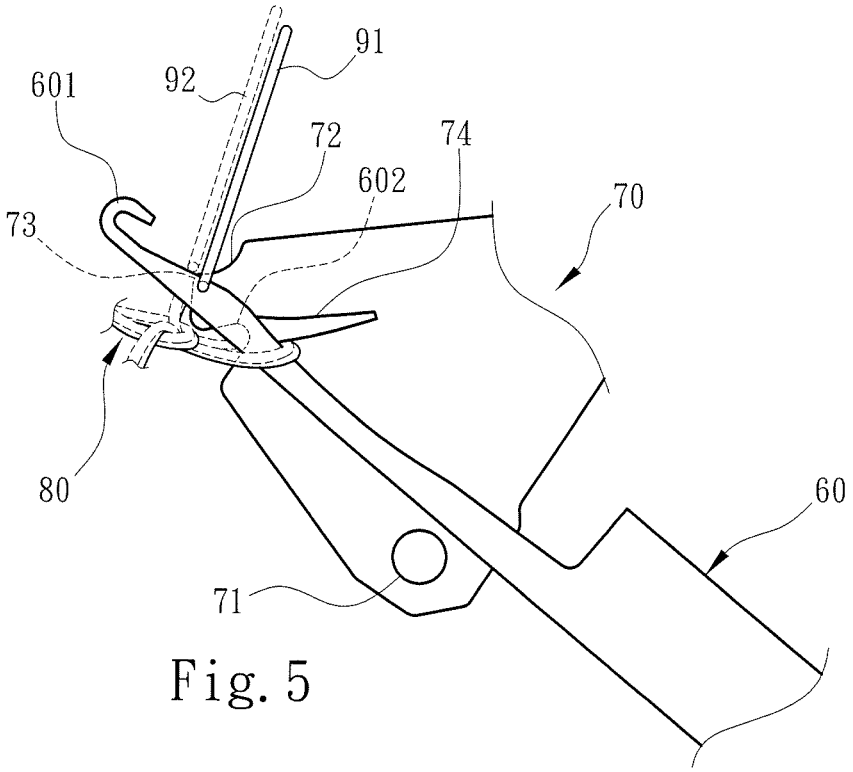
Figure 6:
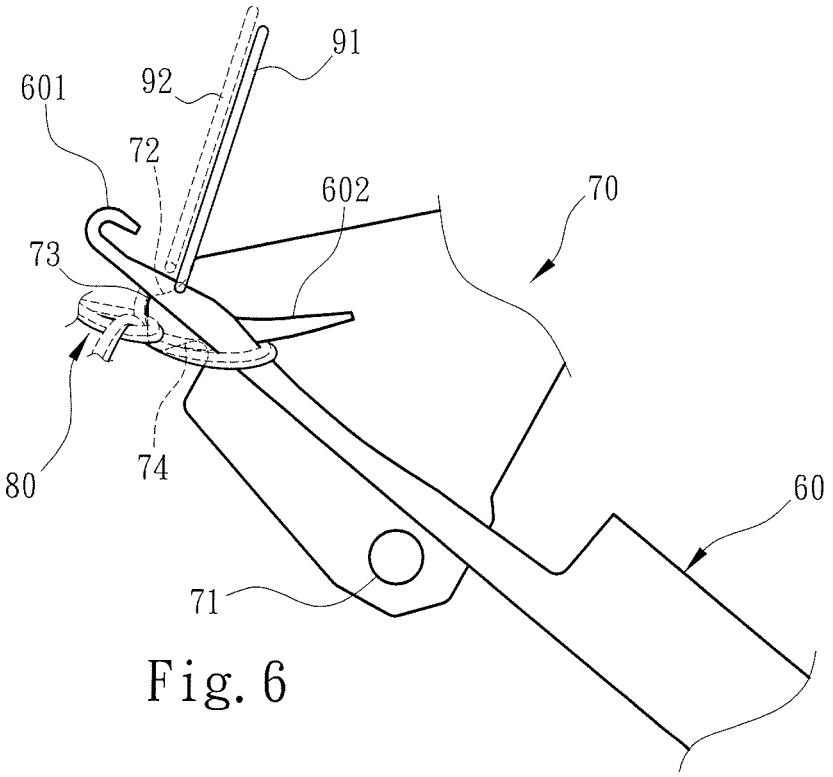
Figure 7:
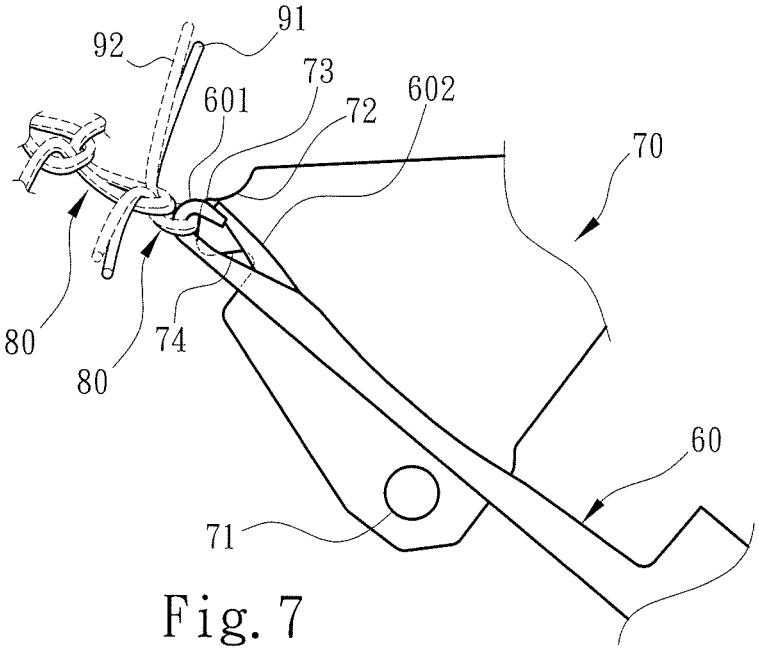
Figure 8:
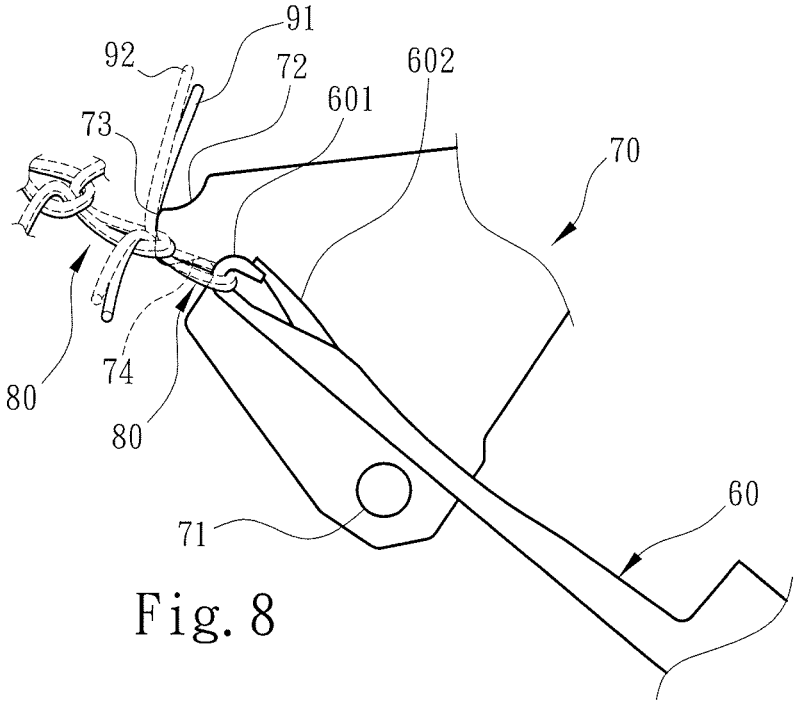
Figure 11:
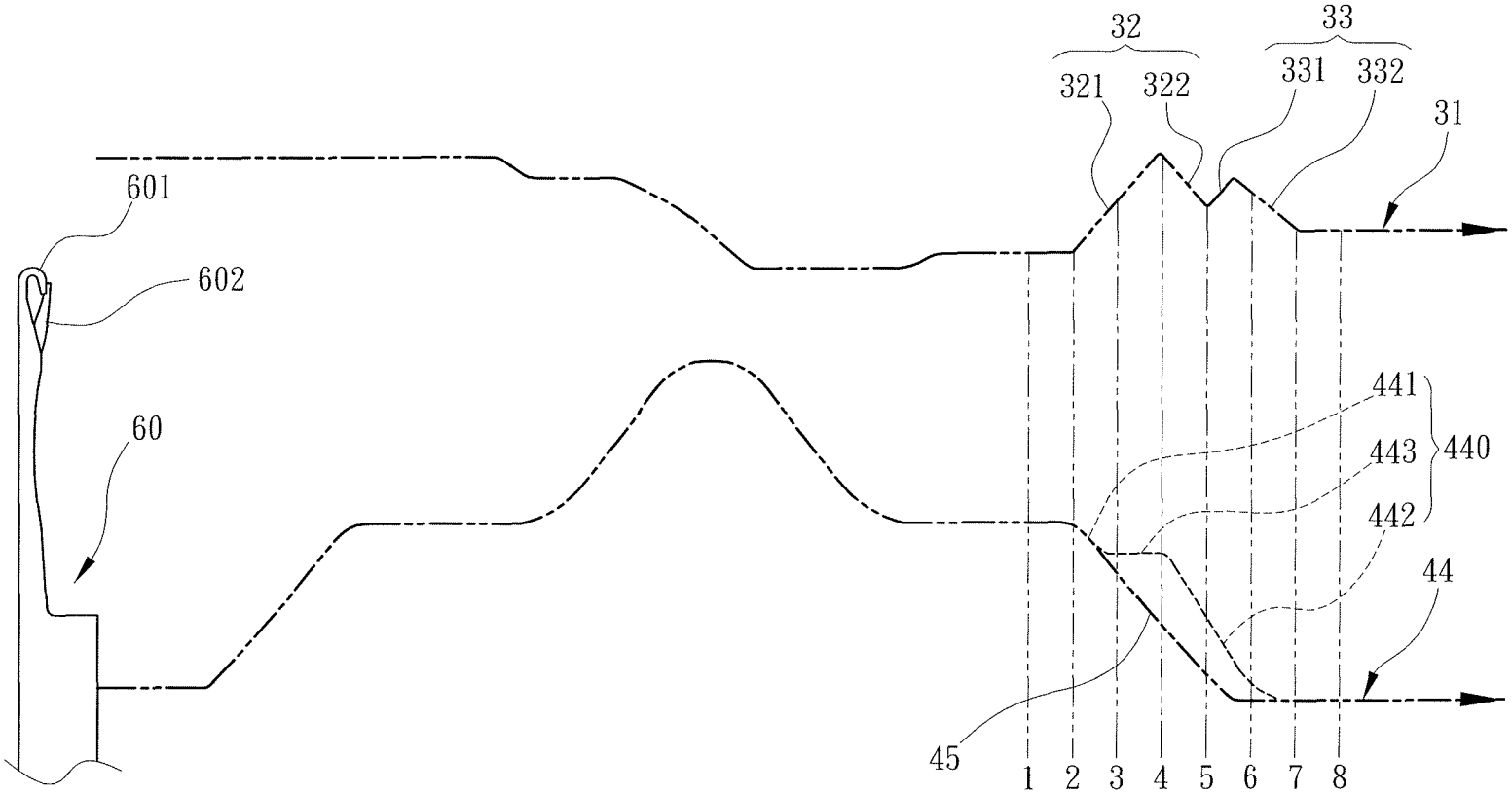
FIG. 11 is a fragmentary schematic plane view of the tracks of the sinker and the latch needle to knit interchanged plating according to the invention.
Figure 12:
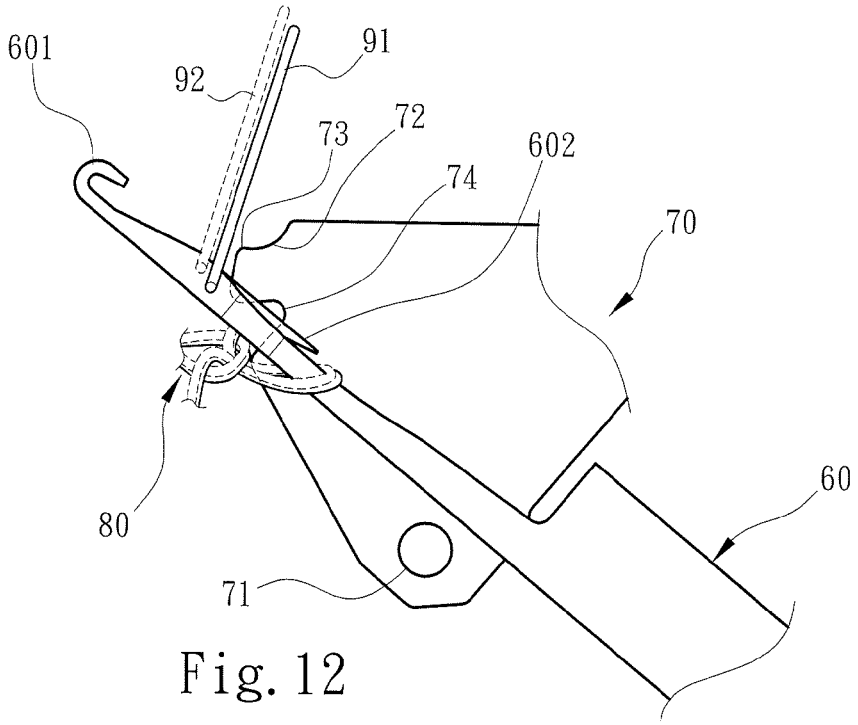
FIGS. 12 through 19 are fragmentary schematic views of the moment positions of the sinker and the latch needle in continuous operation conditions according to FIG. 11.
Figure 13:
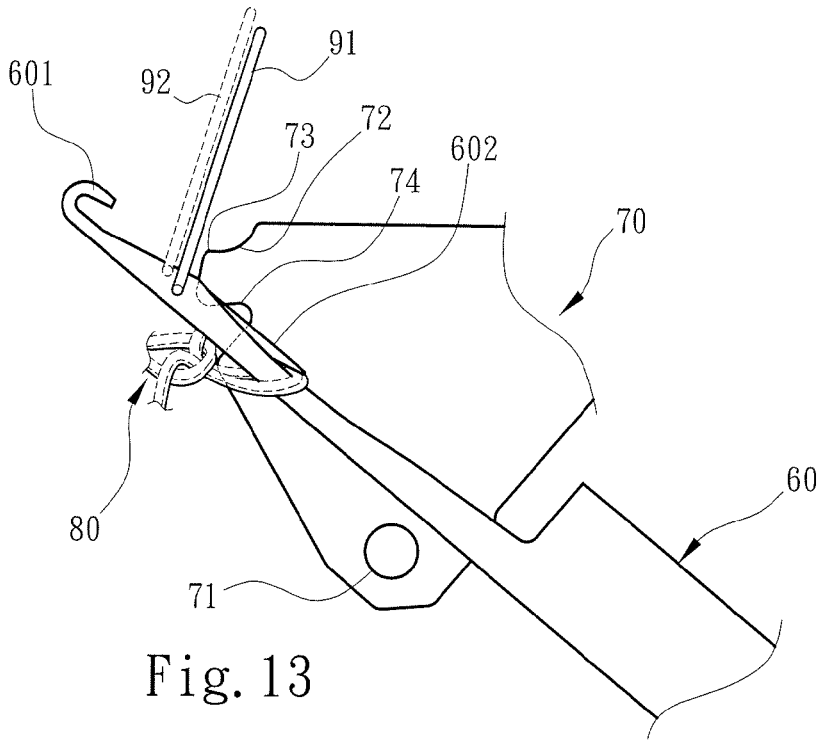
Figure 14:
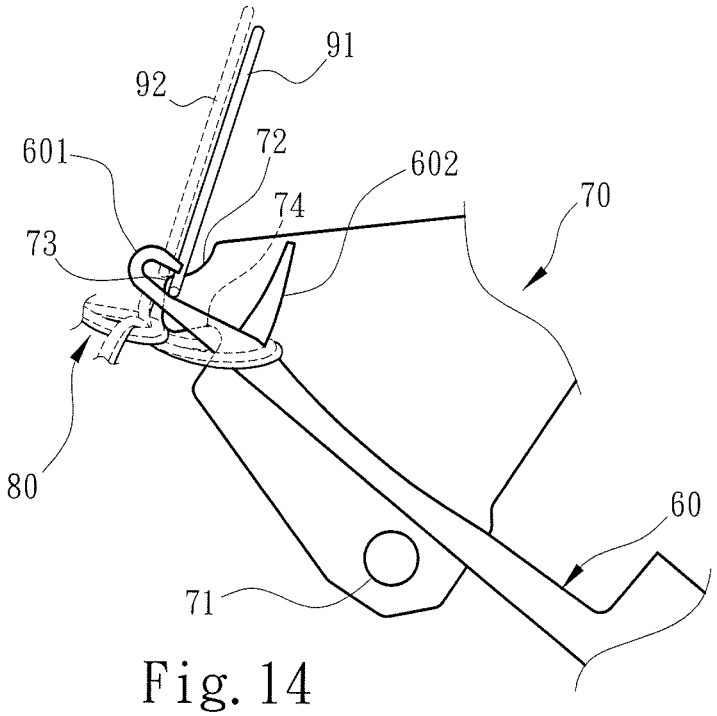
Figure 15:
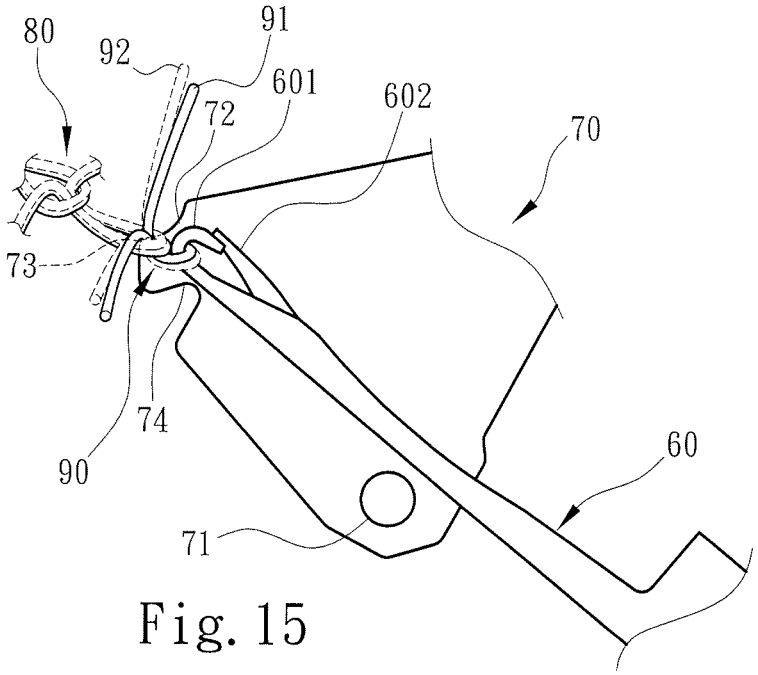
Figure 16:
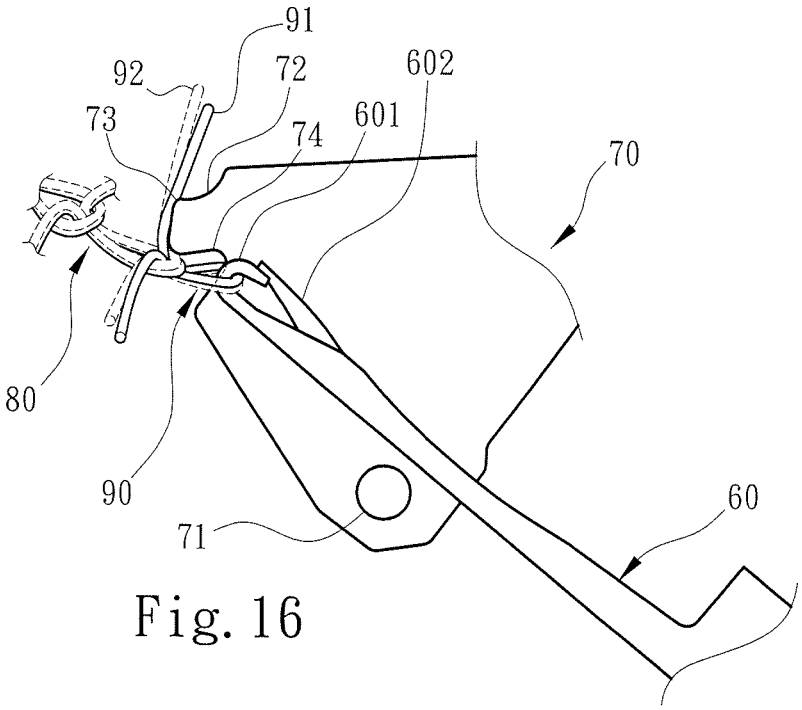

Please also referring to FIGS. 2 through 10, in order to facilitate discussion of forming the standard plating 80 by collaborating the latch needle 60 in the staged stitching displacement 440 and the movement of the sinker 70, eight phantom lines with eight moment positions 1-8 are provided to show the interactive and continuous operation relationship between the latch needle 60 and the sinker 70 (referring to FIG. 2). First, as shown in FIG. 3, at the moment position 1, the distal end of the sinker 70 is not yet being moved to the yarn up slope section 321, the indentation 72 also has no movement, the solid line in the drawing indicates that the first coloration yarn 91 and the second coloration yarn 92 thereabove (indicated by the hidden line) are fed at the same time, and the latch needle 60 does not enter the first stitching section 441 yet, hence no stitching operation is performed. In FIG. 4, at the moment position 2, the distal end of the sinker 70 is at the moment of being driven to enter the yarn picking up slope section 321 and move upward, and the indentation 72 and the nose protrusion 73 also start to move downward, the latch needle 60 has entered the first stitching section 441 to perform first stage stitching operation, but not yet in contact with the first and second coloration yarns 91 and 92. In FIG. 5, at the moment position 3, the distal end of the sinker 70 has been positioned at the yarn picking up slope section 321 and moved upward, the indentation 72 and the nose protrusion 73 also have been moved downward at the same time, and the latch needle 60 is located at the delayed stitching section 443 and pauses stitching operation without in contact with the first and second coloration yarns 91 and 92. In FIG. 6, at the moment position 4, the distal end of the sinker 70 has been moved upward to the summit of the yarn picking up slope section 321, and the indentation 72 and the nose protrusion 73 also are moved to the lowest spot, meanwhile the latch needle 60 is still located at the delayed stitching section 443 to pause stitching operation without in contact with the first and second coloration yarns 91 and 92, while the distal end of the sinker 70 is ready to enter the yarn picking down slope section 322, and the latch needle 60 is preparing to enter the second stitching section 442 to perform stitching operation of a next stage. In FIG. 7, at the moment position 5, the distal end of the sinker 70 is moved downward to the lowest spot of the yarn picking down slope section 322, the indentation 72 and the nose protrusion 73 also stop moving upward at the same time, meanwhile the latch needle 60 is located at the second stitching section 442 to perform again the stitching operation, hence the first coloration yarn 91 indicated via the solid line and the second coloration yarn 92 indicated via the hidden line located thereabove are picked by the hook 61 at the same time to move downward, and the latch 602 also is driven by the standard plating 80 formed in the previous operation to close the hook 601. In FIG. 8, at the moment position 6, the distal end of the sinker 70 has passed through the yarn up slope section 331 to enter the yarn down slope section 332 and move downward, and the indentation 72 and the nose protrusion 73 also are moved downward first at the same time, then move upward, meanwhile the latch needle 60 is still located at the second stitching section 442 to continue the stitching operation, and the first coloration yarn 91 and the second coloration yarn 92 located thereabove that were pulled downward at the same time touch the indentation 72 first, then slide downward over the nose protrusion 73, then are pushed upward again by the nose protrusion 73, such operations aim to make the first coloration yarns 91 and the second coloration yarns 92 thereabove to form more secured relationship potential energy. In FIG. 9, at the moment position 7, the distal end of the sinker 70 has been moved downward and is going to enter the lowest spot of the yarn pushing down slope 332, and the indentation 72 and the nose protrusion 73 also are moved upward at the same time and going to enter a displacement movement stop stage, meanwhile the latch needle 60 has left the second stitching section 442 and stopped the stitching operation, and the first coloration yarn 91 below (i.e., in the front, when viewed upward from the technical face shown in the drawing) and the second coloration yarn 92 located thereabove (behind) have been pulled downward to form a loop (to form another standard plating 80), and the continuous downward movement is stopped; in addition, the first coloration yarn 91 extended from the standard plating 80 and the second coloration yarn 92 located thereabove are sliding into the throat holding portion 74 of the sinker 70. In FIG. 10, at the moment position 8, the distal end of the sinker 70 has fully escaped the yarn pushing down slope section 332, and the indentation 72 and the nose protrusion 73 also stop displacement movement, and the latch needle 60 has fully stopped the stitching operation, the standard plating 80 formed by the first coloration yarn 91 below (in the front) and the second coloration yarn 92 located thereabove (behind) has become a complete loop, the latch needle 60 is waiting to start a next cycle of continuous operation such as stitching, loop cleaning and yarn picking to finish the technical face of the fabric. As previously discussed, during the latch needle 60 is located at the second stitching section 442 the nose protrusion 73 of the sinker 70 pushes the first and second coloration yarns 91 and 92 to slide down at the same time through its front edge to perform knitting operation and form the standard plating 80 with the first coloration yarn 91 below (in front of) the second coloration yarn 92, and the standard plating 80 can be formed continuously to knit the technical face of the fabric. However, when the standard plating 80 has been knitted continuously to reach a predetermined position, the first coloration yarn 91 can be picked up by the junction of the rear edge of the nose protrusion 73 and the indentation 72 of the sinker 70 during the latch needle 60 is located in the interchanged stitching displacement 45 and moved above (behind) the second coloration yarn 92, then release to perform knitting operation to generate operation of forming the interchanged plating 90 with the second coloration yarn 92 located below (in front of) the first coloration yarn 91. Details are elaborated as follows:

Please referring to FIGS. 11 through 19, with FIGS. 12 through 19 showing the fragmentary schematic views of continuous operating conditions of the sinker and latch needle in FIG. 11 at various moment positions. Similarly, in order to facilitate discussion of forming the interchanged plating 90 by the latch needle 60 in the interchanged stitching displacement 45 in collaborating with the yarn picking operation of the sinker 70, eight moment positions 1-8 represented by eight phantom lines are provided to show the interactive and continuous movement relationship between the latch needle 60 and the sinker 70 in FIG. 11. First, as shown in FIG. 12, at the moment position 1, the distal end of the sinker 70 is not yet being driven to enter the yarn up slope section 321, the indentation 72 also has no movement, the first coloration yarn 91 indicated via the solid line in the drawing and the second coloration yarn 92 thereabove (indicated by the hidden line) are fed at the same time, and the latch needle 60 does not enter the first stitching section 441 yet, hence no stitching operation is performed. In FIG. 13, at the moment position 2, the distal end of the sinker 70 is at the moment of being driven to enter the yarn picking up slope section 321 to move upward, and the indentation 72 and the nose protrusion 73 also start to move downward, the first coloration yarn 91 is moved above the indentation 72, meanwhile the latch needle 60 starts entering the interchanged displacement 45 to perform stitching operation without in contact with the first coloration yarn 91 (indicated by the solid line) and the second coloration yarn 92 (indicated by the hidden line), while the latch needle 60 performs the stitching operation rapidly. In FIG. 14, at the moment position 3, the distal end of the sinker 70 has been located at the yarn picking up slope section 321 and moves upward, and the indentation 72 and the nose protrusion 73 also are moved downward at the same time, meanwhile the latch needle 60 is still located in the interchanged displacement 45 to perform the stitching operation rapidly, while the first coloration yarn 91 located above the indentation 72 is pulled downward rapidly to touch the nose protrusion 73 and picked up by the junction of the rear edge of the nose protrusion 73 and the indentation 72 and moved above (behind) the second stitching section 442. In FIG. 15, at the moment position 4, the distal end of the sinker 70 has been moved upward to the summit of the yarn picking up slope section 321, and the indentation 72 and the nose protrusion 73 also are moved downward to the lowest spot, meanwhile the latch needle 60 is still located in the interchanged stitching displacement 45 and also continuously performs the stitching operation rapidly, hence the first coloration yarn 91 has already been picked and moved above the second coloration yarn 92 is caught by the hook 601 to move downward rapidly, and the latch 602 also is driven by the previous standard plating 80 to close the hook 601, and the second coloration yarn 92 is located below (in front of) the first coloration yarn 91 to form the interchanged plating 90; in addition, the first coloration yarn 91 extended from the interchanged plating 90 and the second coloration yarn 92 located therebelow (in front of) are released because the nose protrusion 73 has been moved downward to the lowest spot and starts to slide to the front edge of the nose protrusion 73. In FIG. 16, at the moment position 5, the distal end of the sinker 70 is moved downward to the lowest spot of the yarn picking down slope section 322, the indentation 72 and the nose protrusion 73 also stop at the same time after having moved upward, meanwhile the latch needle 60 is still located in the interchanged stitching displacement 45 to continue the stitching operation, but the interchanged plating 90 of the second coloration yarn 92 located below (in front of) the first coloration yarn 91 is continuously being pulled downward by the stitching operation of the latch needle 60, hence the first coloration yarn 91 extended from the interchanged plating 90 and the second coloration yarn 92 therebelow (in front of) have already slid to the front edge of the nose protrusion 73 and continuously slide downward. In FIG. 17, at the moment position 6, the distal end of the sinker 70 has moved upward through the yarn pushing up slope section 331 to enter the yarn pushing down slope section 332 and move downward, and the indentation 72 and the nose protrusion 73 also are moved downward at the same time, then move upward, meanwhile the latch needle 60 has left the interchanged stitching displacement 45 and stops the stitching operation, and the second coloration yarn 91 below (in the front) and the first coloration yarn 91 thereabove (behind) have already been pulled downward to form a ring (the interchanged plating 90), and the continuous pulling down operation is stopped; meanwhile, the first coloration yarn 91 extended from the interchanged plating 90 and the second coloration yarn 92 therebelow (in the front) have already slid into the throat holding portion 74 of the sinker 70. In FIG. 18, at the moment position 7, the distal end of the sinker 70 has been moved downward and is going to enter the lowest spot of the yarn pushing down slope section 332, and the indentation 72 and the nose protrusion 73 also are moved upward at the same time and are going to enter the lowest spot of the yarn pushing down slope section 332, while the indentation 72 and the nose protrusion 73 are moved upward at the same time and are going to enter the displacement movement stop stage, meanwhile the latch needle 60 has already left the interchanged stitching displacement 45 and stops stitching, and the second coloration yarn 92 below (in the front) and the first coloration yarn 91 thereabove (behind) have already been pulled downward to form a ring (the interchanged plating 90), and the continuous pulling down operation has already stopped. In addition, the first coloration yarn 91 extended from the interchanged plating 90 and the second coloration yarn 92 therebelow (in the front) have already slid into the throat holding portion 74 of the sinker 70. In FIG. 19, at the moment position 8, the distal end of the sinker 70 has fully escaped the yarn pushing down slope section 332, and the indentation 72 and the nose protrusion 73 also stop displacement movement, and the latch needle 60 has fully stopped the stitching operation, meanwhile the latch needle

60 also has fully stopped the stitching operation, and the second coloration yarn 92 below (in the front) and the first coloration yarn 91 thereabove (behind) have formed a complete ring (the interchanged plating 90), and the latch needle 60 is waiting to start a next cycle of continuous operation such as stitching, loop cleaning and yarn picking to finish the technical face of the fabric. As previously discussed, during the latch needle 60 is located in the interchanged stitching displacement 45 the junction of the rear edge of the nose protrusion 73 and the indentation 72 picks up the first coloration yarn 91 and moves it above the second coloration yarn 92, then release to perform knitting operation to form the interchanged plating 90 with the second coloration yarn 92 below the first coloration yarn 91. Through such a technique plating by changing different colors of yarns can be accomplished in plain stitching through a same needle bed, and a technical face of the fabric with different color changes or pattern variations formed through the technical face also can be knitted.

While the preferred embodiment of the invention has been set forth for the purpose of disclosure, it is not the limitation of the invention, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A method for knitting interchanged plating on a technical face of a fabric for a flat bed knitting machine which includes at least one needle bed that comprises a plurality of latch needles and a plurality of sinkers hinged on an upper end of the needle bed, each of the plurality of sinkers respectively adjacent to each of the plurality of latch needles, and a carriage movable reciprocally and linearly above the needle bed, the carriage includes at least one sinker control plate for controlling the plurality of sinkers and at least one needle control plate for controlling the plurality of latch needles, the needle control plate located below the sinker control plate the method comprising the steps of:

forming an indentation at a front end of each sinker that is movable interactively with each latch needle and a nose protrusion abutting the indentation;

controlling the carriage to form a linear and reciprocating movement above the needle bed driving the sinker to move up and down and to form a sinker track, in the meantime, the linear and reciprocating movement of the carriage above the needle bed driving the latch needle to move up and down and to form a needle track, which includes a staged stitching displacement and an interchanged stitching displacement that are switchable, the staged stitching displacement with a pause stitching operation including at least a first stitching section, a second stitching section and a delayed stitching section between the first stitching section and the second stitching section to generate the pause stitching operation;

feeding a first coloration yarn and a second coloration yarn above the first coloration yarn at the same time to the flat bed knitting machine;

moving the first coloration yarn and the second coloration yarn via a front edge of the nose protrusion to slide down at the same time for knitting while the latch needle is positioned at the second stitching section to form a standard plating in which the first coloration yarn is located below the second color yarn, and continuing the knitting operation through the standard plating to form the technical face of the fabric; and performing the interchanged stitching displacement using the plurality of latch needles in the needle track when the technical face of the fabric knitted via the standard plating has reached a predetermined position, and using the plurality of sinkers picking up the first coloration yarn above the second coloration yarn through a junction of a rear edge of the nose protrusion and the indentation, then releasing the yarns to form an interchanged plating in which the second coloration yarn is located below the first coloration yarn.

2. The method of claim 1, wherein the interchanged plating includes two ends to form a contacting point on which the second coloration yarn is located below the first coloration yarn.

3. The method of claim 1, wherein the sinker includes a throat holding portion indented from a lower side of the front edge of the nose protrusion.

4. The method of claim 2, wherein the sinker includes a throat holding portion indented from a lower side of the front edge of the nose protrusion.

5. The method of claim 1, wherein the carriage moves reciprocally and linearly above the needle bed to drive a distal end of the sinker to move up and down to form a sinker track on at least one sinker control plate; the sinker track including at least a yarn picking displacement to pick up the first coloration yarn through the junction of the rear edge of the nose protrusion and the indentation above the second coloration yarn then release, and a yarn pushing displacement to push the first coloration yarn and the second coloration yarn to slide down at the same time through the front edge of the nose protrusion; the yarn picking displacement including a yarn picking upslope section and a yarn picking down slope section, and the yarn pushing displacement including a yarn pushing upslope section and a yarn pushing down slope section.

* * * * *